United States Patent [19]

Panetti

[11] Patent Number: 4,492,059

[45] Date of Patent: Jan. 8, 1985

[54] GRINDING DEVICE FOR THE REPROFILING OF A RAIL OF A RAILWAY TRACK

[75] Inventor: Romolo Panetti, Geneva, Switzerland

[73] Assignee: Speno International S.A., Geneva, Switzerland

[21] Appl. No.: 560,262

[22] Filed: Dec. 12, 1983

Related U.S. Application Data

[63] Continuation of Ser. No. 279,554, Jul. 1, 1981, abandoned.

[30] Foreign Application Priority Data

Jul. 23, 1980 [CH] Switzerland ..... 5331/80

[51] Int. Cl.[3] ..... B21B 7/00; B21B 23/00

[52] U.S. Cl. ..... 51/178; 51/99; 51/72 R

[58] Field of Search ..... 51/178, 3, 5, 99, 72 K

[56] References Cited

U.S. PATENT DOCUMENTS

| | | | |
|---|---|---|---|
| 3,358,406 | 12/1967 | Speno, Jr. et al. | 51/178 |
| 3,593,465 | 7/1971 | Krippes | 51/178 |
| 3,823,455 | 7/1974 | McIlrath et al. . | |
| 3,908,317 | 9/1975 | Hambrick et al. | 51/178 |
| 3,945,142 | 3/1976 | Keppeler . | |
| 3,945,152 | 3/1976 | Helgemeier | 51/178 |
| 4,135,332 | 1/1979 | Theurer | 51/178 X |

FOREIGN PATENT DOCUMENTS

| | | |
|---|---|---|
| 463676 | 7/1975 | Australia . |
| 476516 | 9/1976 | Australia . |
| 1141305 | 12/1962 | Fed. Rep. of Germany . |
| 2263958 | 7/1974 | Fed. Rep. of Germany . |
| 2612174 | 6/1977 | Fed. Rep. of Germany . |

*Primary Examiner*—E. R. Kazenske
*Assistant Examiner*—Willmon Fridie, Jr.
*Attorney, Agent, or Firm*—Yount & Thompson

[57] ABSTRACT

A grinding device for the reprofiling of a rail of a railway track, comprises at least one grinding unit having a conical grinding wheel rotatably driven by a motor. The motor is secured to a bracket connecting it rigidly to the chamber of a jack whose piston is secured to a rod fixed on the carriage of a railroad vehicle. The jack makes it possible to cause feeding movement of the grinding wheel along a direction parallel to the side profile of the grinding wheel and defining the cutting depth and compensating for wearing away of the grinding wheel. This feeding movement of the grinding wheel takes place along a direction forming an angle with the axis of rotation of the conical grinding wheel, this angle being about half the summit angle of the conical grinding wheel.

10 Claims, 6 Drawing Figures

FIG. 1
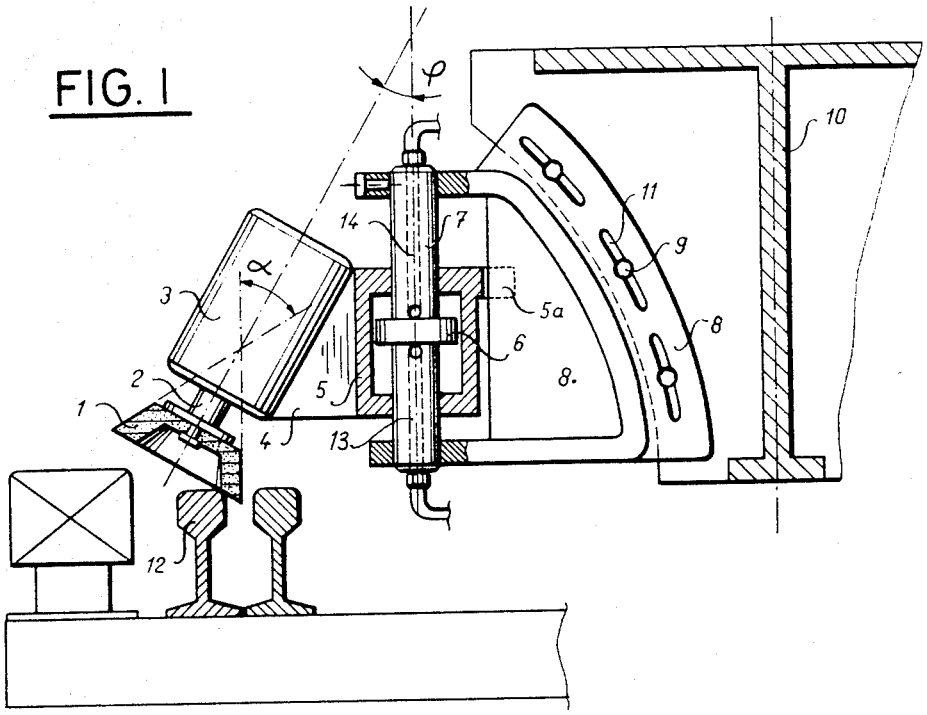
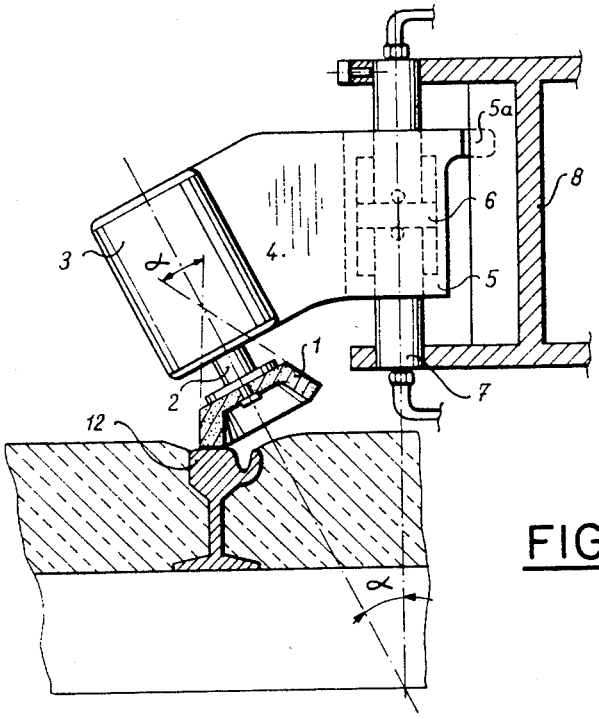
FIG. 2

GRINDING DEVICE FOR THE REPROFILING OF A RAIL OF A RAILWAY TRACK

This is a continuation of application Ser. No. 279,554 filed 7-1-81 now abandoned.

The present invention relates to a grinding device for reprofiling in situ a rail of a railway track, comprising at least one rotatable grinding tool driven by a motor. One or more of these devices are mounted one behind the other on a guiding carriage of a vehicle which moves along the track, means being provided to position the grinding tools, with respect to the rail, particularly with respect to the head of the rail, and to apply the grinding tools against the rail for reprofiling it during movement of the vehicle along the track.

Such grinding devices are known for reshaping railroad rails, and can be grouped in three main categories:

1. Grinding devices using lapidary grinding wheels, that is, bell-shaped grinding wheels having a cylindrical perimeter whose working surface is their front annular surface. These grinding wheels are used for example on the device disclosed in Swiss Pat. No. 583,537.

These devices have the drawback of great width on either side of the rail, equal to the diameter of the grinding wheel. This width is such that it is not compatible with the obstacles normally present along a track such as level crossings, counter rails, shaft counters or signal boxes.

During reprofiling of the rails of a track with devices using lapidary grinding wheels, it is necessary to observe these obstacles while travelling along the track and to lift the grinding wheels to avoid contacting these obstacles. Such surveillance is difficult and there results a loss of time and sometimes damage to the grinding wheels or to the structures located in the immediate vicinity of the rail and worst of all causes a discontinuity of the grinding.

To avoid these drawbacks, attempts have been made to reduce the diameter of the lapidary grinding wheels to avoid their overhanging the rail so as to avoid contact with obstacles along the track. This leads however to a very quick wearing away of the grinding wheels, their working surface and their volume being greatly reduced, and this necessitates frequent interruptions to change the grinding wheels.

2. Devices using peripheral grinding wheels or disc-shaped grinding wheels in contact with the rail on their periphery. Reprofiling devices for rails using such peripheral grinding wheels are dissclosed for example in U.S. Pat. No. 3,738,066 or in French published application No. 71 09531. The great disadvantage of such devices is that the grinding wheels grind round surfaces and not flat surfaces. Therefore, the working surface of the grinding wheel takes the shape of the ground object and thus becomes concave. With such a deformed grinding wheel, it is not possible to impart to the rail a correct profile.

There are devices, for example as disclosed in U.S. Pat. No. 3,823,455, for preparing the ends of rails for welding. Such devices are peripheral grinding wheels of cylindrical or truncated conical shape. They do not permit reprofiling the head of a rail.

To avoid these drawbacks, it has been proposed mechanically to true the grinding wheel either from time to time, requiring the halting and the temporary incapacitation of the reprofiling installation, or continuously, which requires a complicated mechanism and causes an unacceptable wearing of the grinding wheel which greatly reduces its lifetime.

There have also been proposed devices in which the grinding wheel is driven with a reciprocatory movement parallel to the base to the surface to be ground, to avoid deformation of its working surface. But this requires a complicated and precise mechanism. Furthermore, the grinding wheel overhangs alternately on either side of the rail and its width is increased and no longer permits the grinding of the side of the head of the rail in the presence of, for example, a counter rail.

When using these last peripheral grinding wheels by driving them rotatably about a vertical axis, the same difficulties as to size are encountered as with lapidary grinding wheels.

3. Also known, for example as in Austrian Pat. No. 327,979, are grinding devices using conical grinding wheels instead of lapidary grinding wheels, in view of the easier securement of these grinding wheels. The known conical grinding wheels, however, have the same difficulties as lapidary grinding wheels, namely, too great a width.

4. Finally, there are also known, for example as in German Pat. No. 2,612,174, reprofiling devices for the rails of railway track, comprising grinding units mounted on tool carriers which are movable with respect to supports in a direction parallel to the axis of rotation of the grinding wheels. These supports are themselves vertically displaceable with respect to the frame of the machine. The grinding wheels are cylindrical and have a front working surface having the shape of a truncated cone. The lateral width of such cylindrical grinding wheels having a front working surface having the shape of a truncated cone is great, due to the fact that the angle formed by their axis of rotation relative to the vertical is small. With this type of machine, it is necessary to stop grinding in the vicinity of a counter rail or signal block or a switch, in order to lift the grinding wheels which otherwise would strike these obstacles.

All these known devices also have the added disadvantage of leaving unground zones on the rail, when the grinding wheels are lifted to avoid obstacles, with the result that the depth of cut is not regular.

It is an object of the present invention to provide a grinding device for a rail which overcomes the above difficulties and which permits achieving simultaneously the following aims:

(a) a correct reprofiling of the rail in any environment, that is, adjacent level crossings, switch points, counter rails or other obstacles encountered along the track.

(b) the use of a grinding wheel having a normal diameter while avoiding too rapid wear on the grinding wheel.

(c) an automatic truing of the working surface of the grinding wheel to avoid major deformation of it which would lead to improper reprofiling of the rail.

This object is achieved by the present invention by providing a grinding device in which the grinding wheel has a peripheral surface having the shape of a non-cylindrical surface of revolution, the device comprising means causing a feeding movement of the grinding wheel, defining the cutting depth and compensating for wear on the grinding wheel in a direction approximately parallel to the sideline of the grinding wheel in the vicinity of its contact with the rail.

The accompanying drawings show schematically and by way of example several embodiments of grinding devices according to the invention.

In the drawings:

FIGS. 1–3 are views partially in cross section of three embodiments of apparatus according to the invention;

Figure 3:
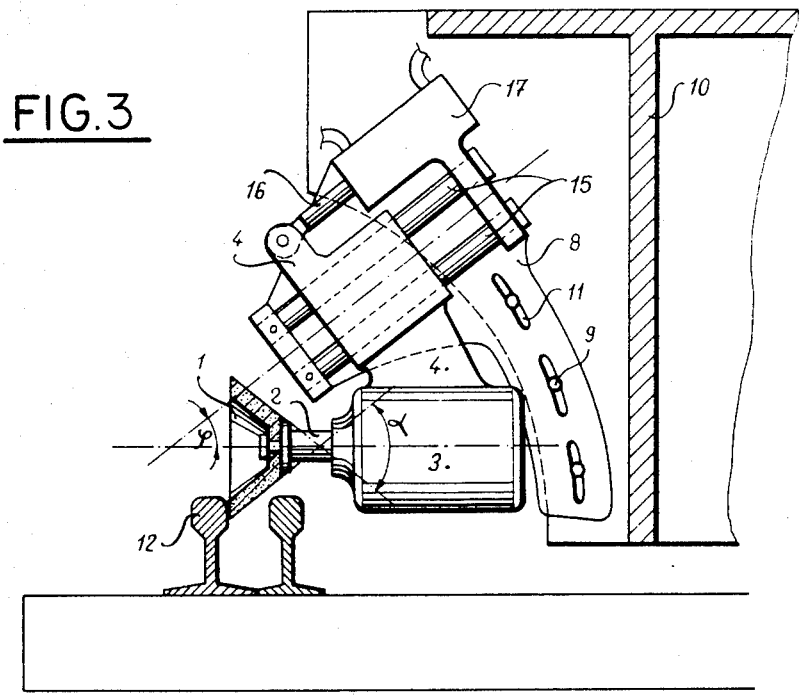

In the following text, different embodiments will be described, in which the grinding wheel is conical, its peripheral surface of revolution being a truncated cone, which permits providing for a rectilinear forward stroke of the grinding wheel approximately parallel to its side profile adjacent the point of contact with the rail.

Referring to FIG. 1, the grinding device comprises a bell-shaped grinding wheel or lapidary conical grinding wheel 1, whose peripheral surface is constituted by a truncated cone. This conical grinding wheel 1 is secured to the shaft 2 of an electric drive motor 3.

In this embodiment, the active working surface of the grinding wheel is planar and perpendicular to the axis of symmetry and of rotation of the grinding wheel 1.

The driving motor 3 is fixedly secured on a lug 4 which is secured to the chamber 5 of a double-acting jack whose piston 6 is secured to a grinding column 7 that extends through opposite sides of chamber 5. This grinding column 7 is secured to a support 8 fixed by means of bolts 9 on a carriage 10 of a railroad vehicle. Thanks to the slots 11 of the support 8, it can be fixed on the carriage 10 in different orientations in order to modify the position of the grinding wheel 1 with respect to the rail 12 according to the position of the head of the rail which is to be reprofiled. Two lugs 5*a* on the chamber of the jack 5, disposed on opposite sides of the support 8, fix the angular position of the chamber of jack 5 with respect to the column 7.

The grinding column 7 is provided with ducts 13, 14 feeding the chamber 5 on respectively opposite sides of piston 6 of the pneumatic or hydraulic jack 5, 6.

In this embodiment, in which grinding wheel 1 reprofiles the side of the head of the rail, the angle $\rho$ between the axis of the jack 5 which feeds the grinding wheel 1 a distance defining the cutting depth and compensating for the wearing off of the grinding wheel, and the axis of rotation of the grinding wheel is of the order of 30°. This angle can be selected within wide limits as a function of the portion of the rail which has to be reprofiled.

In the example shown, this angle $\rho$ is approximately equal to half the summit angle $\alpha$ of the conical grinding wheel 1, so that the feeding direction of the grinding wheel 1 toward the rail is approximately parallel to the outside line of the grinding wheel in the vicinity of its contact point with the rail.

Thanks to the use of a conical grinding wheel 1, and the fact that its shaft 2 makes an angle $\rho$ with the direction of forward stroke of the grinding wheel, the grinding device is positioned with respect to the track so that a counter rail, a signal box or any obstacle along the track is disposed outside the path of the grinding wheel during forward movement of the vehicle along the track.

In the second embodiment shown in FIG. 2, there is also a conical grinding wheel 1 having a driving motor 3 carried by a bracket 4 as well as a jack 5, 6, 7 controlling the forward stroke of the grinding wheel, as well as the support 8.

Here also the axis of rotation of the grinding wheel 1 is disposed at an angle $\rho$ relative to the forward direction of the grinding wheel defined by the axis of the jack 5, 6, 7.

In this embodiment, the front working surface of the grinding wheel 1 has the shape of a truncated cone and meets the peripheral surface of the grinding wheel, which also has the shape of a truncated cone, approximately at right angles. This arrangement is particularly advantageous to reprofile the upper rolling surface of the rail 12. It will be seen that, thanks to this construction, this upper rolling surface of the rail can be reprofiled even at level crossings where the rail 12 is practically embedded in the ground.

In this embodiment also, the angle $\rho$ defined between the axis of rotation of the grinding wheel and its feeding direction, that is, the axis of jack 5, 6, 7, is about equal to half the summit angle $\alpha$ of the conical grinding wheel 1. The feed of the grinding wheel takes place substantially parallel to its side profile in the vicinity of its contact point with the rail.

The support 8 can in this embodiment be mounted on the carriage as seen for example in FIG. 1. Thus it is possible to incline the grinding wheel with respect to the rail to be reprofiled, as a function of the portion of the rolling surface that has to be reprofiled.

FIG. 3 shows an embodiment of the grinding device of the present invention, used to reprofile the lateral face of the head of a rail.

The conical grinding wheel 1 is driven in rotation by motor 3 about a horizontal axis. Bracket 4 secured to motor 3 slides on two rods 15 secured to support 8. A lug on bracket 4 is hinged to rod 16 of a double acting jack 17 controlling the feeding stroke of the grinding wheel 1. In this embodiment also, the feeding direction of the grinding wheel 1, parallel to the rods 15, forms an angle $\rho$ with the axis of rotation of the grinding wheel 1 and is substantially parallel to the side profile of the grinding wheel in the neighborhood of its contact point with the rail. The angle $\rho$ is here about 45° and the summit angle $\alpha$ of the grinding wheel 1 is about 90°.

It will be apparent that on the same guiding carriage, there can be provided several grinding devices or groups of grinding devices which can be identical to each other or different and can be adapted to reprofile different portions of the head of the rail. All these grinding devices are disposed outside the path of obstacles located along the track, thereby improving working safety and saving time, because the grinding train does not have to stop to raise the grinding wheels to avoid the obstacles, and further guaranteeing the continuity and precision of grinding.

It is thus avoided that unground zones on the rail alternate with ground zones, and a constant cutting depth over the whole length of the rail can be achieved.

In the three embodiments described, the support 8 can be displaced angularly with respect to the tool carrier carriage 10 to enable different portions of the head of the rail to be ground. This displacement is by rotation about an axis parallel to the rail, and in the example shown about an imaginary axis located within the rail, more particularly within the head of the rail. This displacement does not change the angle $\rho$ between the feeding direction of the grinding wheel and its axis of rotation, but rather permits adjusting the direction according to which the grinding wheel is moved along the rail.

Figure 6:
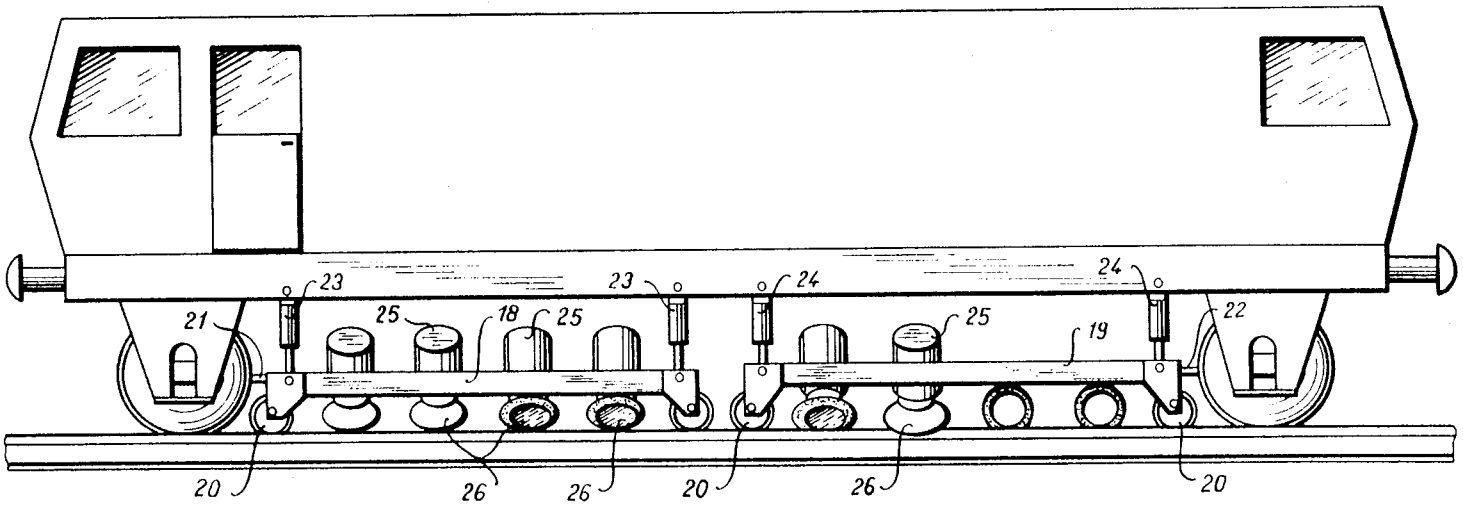
FIG. 6 is an overall view showing the mounting on a rail reprofiling vehicle for a track, of the grinding device shown in FIGS. 4 and 5.

FIG. 6 shows a railroad vehicle for reprofiling the rails of a railway track, provided with two tool carrier carriages 18, 19 rolling on the rail by means of flanged wheels 20, connected to the frame of the vehicle on the one hand by means of driving linkages 21, 22 of the carriage along the rail, and on the other hand by means of hinged linkages comprising jacks 23, 24 making it possible to displace the carriage vertically with respect to the frame of the vehicle and making it possible also to apply the carriages against the rail 12 with a given force.

Figure 5:
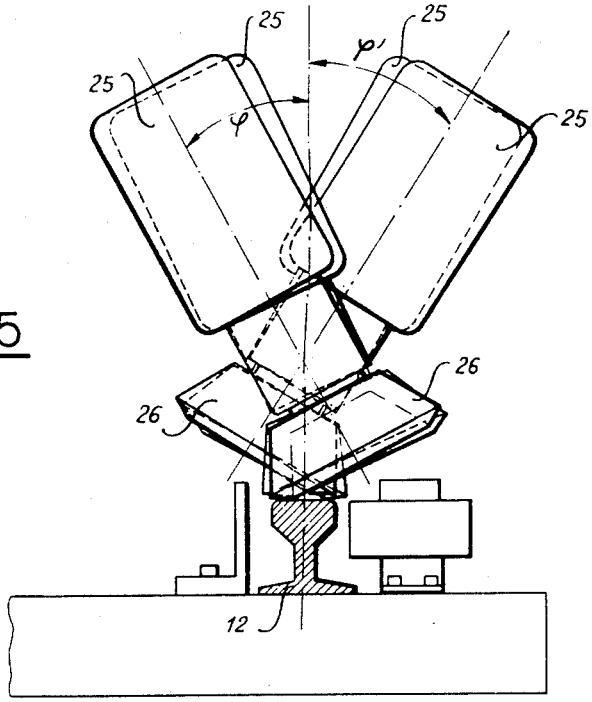
FIG. 5 is a schematic cross-sectional view taken along the line V—V of FIG. 4.
Figure 4:
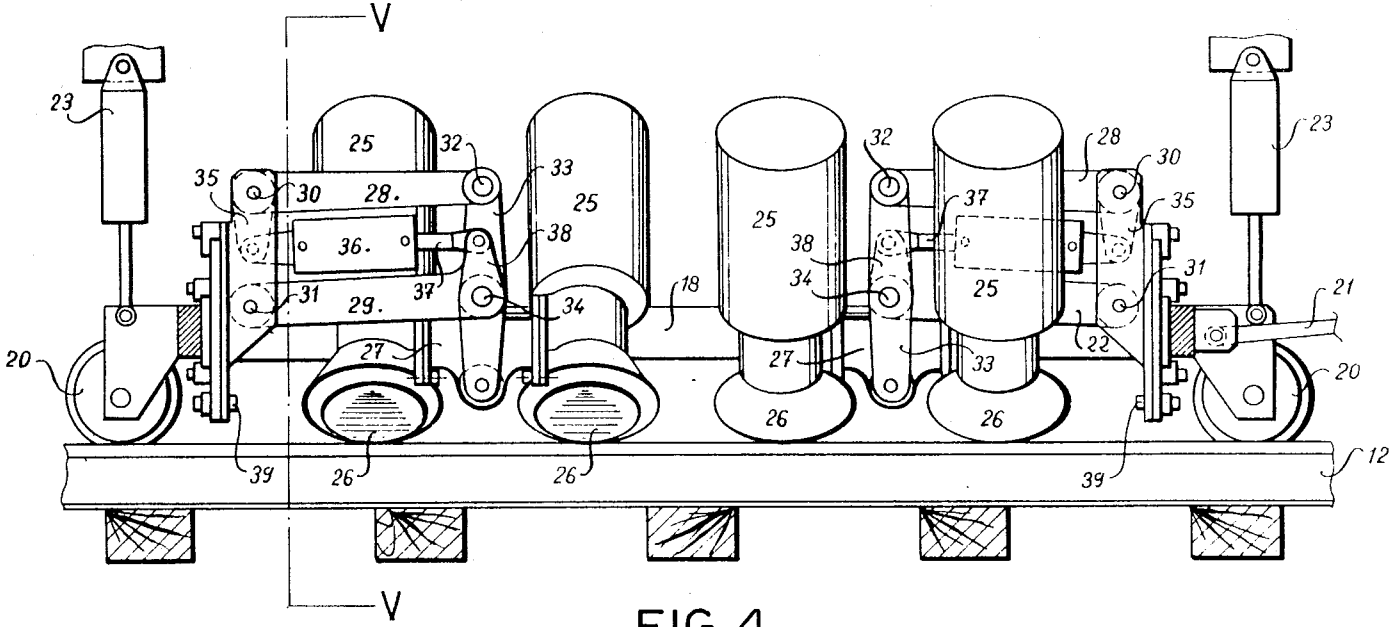
FIG. 4 is a side view of a group of two grinding devices according to a fifth embodiment, mounted on the grinding carriage of a railway vehicle.

As is shown in detail in FIGS. 4 and 5, each carriage carries two grinding devices having each two working units comprised by a driving motor 25 and a conical grinding wheel 26. The two working units of the same grinding device are rigidly connected through a support 27.

The connection of this support 27 to the carriage 18 is effected by means of levers forming a deformable parallelogram. Two parallel levers 28, 29 are pivoted at one of their ends to the carriage at 30, 31, respectively. The free end of lever 28 is pivoted at 32 on one end of rod 33 whose other end is pivoted on the support 27. The free end of the lever 28 is pivoted at 34 on rod 33.

The distances separating the pivot points 30, 31, and 32, 34, as well as the pivot points 30, 32 and 31, 34, are respectively equal so as to form a deformable parallelogram. The rod 33 extends vertically, as does also the line connecting the pivot points 30 and 31.

The end of lever 28 pivoted on the carriage comprises an ear 35 hinged to the housing of a double-acting jack 36 whose rod 37, secured to its piston, is pivoted on an ear 38 of the lever 29 pivoted on the rod 33.

Thus, when jack 36 exerts pressure between the two ears 35, 38, rod 33 tends to displace the support 27 vertically downward, resulting in a feeding displacement of the grinding wheel in the direction of the rail 12. Traction on the ears 35, 38, on the other hand, results in upward vertical displacement of the support 27.

In this case, also the axis of rotation of the grinding wheels 26 does not extend along the feeding direction of these grinding wheels, controlled by the rod 33, but rather forms an angle $\rho$ with respect to this direction. This angle $\rho$ can be adjusted by modifying the angular position of each working unit with respect to the support 27.

In this way, the feeding direction of the grinding wheels is substantially parallel to their side profiles in the vicinity of their contact points with the rail; and the result of this is that in this case also the feeding movement of the grinding wheel does not increase its lateral extent, so that it avoids conflict with obstacles along the track.

The entire parallelogram device described above can be pivoted around axis 39 in order to orient the feeding movement of the grinding wheel as a function of the portion of the rail to be ground.

Thanks to this arrangement, the same advantages are obtained as are described above, particularly as to the lateral extent of the grinding wheels along the track, as can be seen from FIG. 5 which is a partial schematic view on line V—V of FIG. 4.

It is to be noted in FIG. 5, that each unit comprising a motor 25 and grinding wheel 26 is adjusted with different inclination relative to the rail, in order to reprofile different portions of the surface of the head of the rail. This is achieved in this embodiment by mounting each motor-grinding wheel unit on the support 27 by means of bolts and slots, as in the preceding embodiments, which makes possible this angular adjustment. Here also the pivoting of the motor-grinding wheel unit with respect to the support 27 takes place preferably along the arc of a circle centered on an imaginary axis parallel to the rail 12, that is, to the direction of movement of the vehicle, this imaginary axis being located inside the rail.

It will be seen from FIG. 5 that the units can be inclined either inside the track with an angle $\rho$, or outside the track with an angle $\rho'$, without interfering with obstacles disposed along the track.

Thanks to this angular displacement, in a vertical plane perpendicular to the rail, between the feeding direction of each grinding wheel and its axis of rotation, the grinding wheel assumes an inclined position and its lower peripheral portion is in contact with the rail. The greatest part of the grinding wheel is disposed above the rail outside the area occupied by the obstacles. It is therefore possible with this arrangement to maintain the grinding wheels operatively against the rail permanently even when moving along obstacles such as level crossings, signal boxes, counter rails, etc., thereby permitting an appreciable saving of time, ensuring great precision of reprofiling, and above all effecting an exact grinding since the grinding wheels are always in contact with the rail. Furthermore, the lateral extent of the grinding wheel with respect to obstacles remains the same whatever may be the forward feeding of the grinding wheel.

I claim:

1. In a grinding device for reprofiling a rail of a railroad track, comprising at least one grinding unit having at least one grinding wheel rotatably driven about an axis by a motor, means mounting said device on a grinding carriage of a vehicle adapted to move along the track, means to change the elevation of the grinding unit relative to the vehicle and to force the grinding unit against the rail, the grinding wheel having a front working surface; the improvement in which the grinding wheel has a conical peripheral surface having two side profiles on opposite sides of the grinding wheel intersecting above the rail on said axis of rotation of the grinding wheel, said two side profiles lying in the plane that is perpendicular to the length of the rail and in which plane said axis lies, and linear actuating means to feed the grinding wheel along a path approximately parallel to the said side profile that is closer to the rail surface that is being ground and toward the rail in said plane in which said axis lies, said path making an angle with the axis of rotation of the grinding wheel which is approximately equal to half the angle formed by said intersecting side profiles of the grinding wheel.

2. A device as claimed in claim 1, in which said working surface is flat and perpendicular to the axis of rotation of the wheel.

3. A device as claimed in claim 1, in which the angle formed between the feeding path of the grinding wheel and its axis of rotation is about 30°.

4. A device as claimed in claim 1, in which the angle formed between the feeding path of the grinding wheel and its axis of rotation is about equal to 45°.

5. A device as claimed in claim 1, said feed means for the grinding wheel comprising a set of levers forming a deformable parallelogram connecting at least one grinding unit to the carriage, and a jack for deforming the parallelogram.

6. A device according to claim 1, in which a plurality of grinding units are mounted pairwise on a single support.

7. A device as claimed in claim 6, in which the feeding path of the grinding wheels of the grinding units mounted on the same support is the same.

8. A device as claimed in claim 7, and adjusting means for the inclination of each of the grinding units with respect to their common support.

9. A device as claimed in claim 1, in which the working surface of the grinding wheel is frustoconical.

10. A device as claimed in claim 1, in which said grinding wheel has the shape of a bell.

* * * * *